US005580320A

United States Patent [19]

Meikle

[11] Patent Number: 5,580,320

[45] Date of Patent: Dec. 3, 1996

[54] TARGET GREEN FOR GOLF PRACTICE

[76] Inventor: John B. Meikle, 5 Ellis Ct., Rye, N.Y. 10580

[21] Appl. No.: 591,163

[22] Filed: Jan. 16, 1996

Related U.S. Application Data

[63] Continuation of Ser. No. 298,760, Aug. 31, 1994, abandoned, which is a continuation-in-part of Ser. No. 214,384, Mar. 17, 1994, abandoned, which is a continuation of Ser. No. 943,498, Sep. 11, 1992, Pat. No. 5,297,795.

[51] Int. Cl.[6] ..... A63B 69/36

[52] U.S. Cl. ..... 473/197; 473/172; 473/168; 473/164; 473/162; 473/160

[58] Field of Search ..... 273/176, 181; 473/150, 160, 161, 162, 163, 164, 168, 172, 173, 195–197

[56] References Cited

U.S. PATENT DOCUMENTS

| | | | |
|---|---|---|---|
| 2,678,823 | 5/1954 | Hugman | 273/176 H |
| 3,508,756 | 4/1970 | Bedford | 273/176 H |
| 3,578,333 | 3/1971 | Elesh . | |
| 3,595,581 | 7/1971 | Anderson | 273/176 H |
| 3,944,232 | 3/1976 | Tierney | 273/176 H |
| 4,141,557 | 2/1979 | Ingwersen | 273/181 F |
| 4,202,547 | 11/1980 | Mueller . | |

FOREIGN PATENT DOCUMENTS

| | | | |
|---|---|---|---|
| 540 | 1/1977 | Japan | 273/176 H |
| 4348771 | 12/1992 | Japan | 273/176 H |

*Primary Examiner*—Mark S. Graham
*Attorney, Agent, or Firm*—Hopgood, Calimafde, Kalil & Judlowe

[57] ABSTRACT

An artificial golf green is designed for use at driving ranges. The target green structure is formed at an incline to provide users of the golf range the appearance of a much larger target surface due to the perspective effects when viewing an inclined object from a distance. The construction of the target green is sectional to facilitate transportation. The landing surface includes artificial turf and an energy absorbing pad for more realistic performance.

20 Claims, 4 Drawing Sheets

TARGET GREEN FOR GOLF PRACTICE

This application is a continuation of application Ser. No. 08/298,760, filed Aug. 31st, 1994, now abandoned, which is a continuation-in-part of application Ser. No. 08/214,384, filed Mar. 17th, 1994, abandoned, which is a continuation of application Ser. No. 07/943,498, filed Sep. 11th, 1992, now U.S. Pat. No. 5,297,795, the disclosures of which are both incorporated herein by reference.

The present invention generally relates to structures configured to give the outward appearance of select surfaces associated with the game of golf and, more particularly, to an apparatus designed and configured to give the outward appearance, when viewed from a distance, of a golf green and the attendant features associated with the green structure including a hole and pin, and optionally surrounding rough and hazards, such as sand traps, water, and the like, especially for use as a target green.

BACKGROUND OF THE INVENTION

The game of golf has exploded in popularity in the past 15 years, with a dramatic increase in overall use of existing golf facilities, such as public and private courses and driving ranges. As more and more individuals take up the sport of golf, there has been a corresponding saturation of existing golf courses and the resources available to teach golf to newcomers. This has had the unpleasant side effect of creating significant waiting periods for course access and time consuming use of courses by beginners.

In addition to actual play on a certified golf course, many players visit golf "driving ranges" for extra practice at their game. A golf driving range is a large open area such as a grass covered field, with a line of hitting platforms arranged along one edge of the field. These individual hitting platforms will often include a tee for hitting golf drives into the field. In this regard, the driving range is operated for profit by renting to a customer a basket of practice golf balls that are then used by the customer at the hitting platform. More particularly, the customer will tee up the practice ball and hit it into the field; this is repeated for each ball in the basket providing concentrated practice to the customer with one or more clubs that is perceived needing work.

The use of driving ranges for practice and teaching provides a useful release valve on the overcrowding of the actual golf courses. Lessons can be given at a leisurely pace without inconveniencing following groups of players. Indeed, the novice golfer can develop sufficient skill at the driving range prior to venturing out on a golf course in play.

Notwithstanding the above-noted benefits, driving ranges suffer several significant drawbacks, limiting their usefulness in several aspects. Primarily, a driving range provides no semblance of the actual golf game on a real course. Although the golf swing is unchanged, the target in a driving range is a large open field with possibly some yardage markers indicating distance from the hitting platform. The use of a golf green, i.e., the actual targets in golf, at the driving range is precluded as uneconomical or impractical for the intended purpose. Even when provided, a green is located at a significant distance from the player, inhibiting the player's ability to observe the accuracy of his shot relative to the green. Whatever the reason, the outcome is that the customer is unable to gauge the accuracy of his/her hitting as it relates to the actual game of golf during his/her session at the range.

Ingwersen, in U.S. Pat. No. 3,990,708, describes an indoor/outdoor recreational facility having a simulated green comprising a grid of squares, each square having a hole into which a golfed ball will roll and is mechanically retrieved. The simulated green includes apparatus for relaying to the golfer information about in which grid portion the golfed ball landed. The simulated green is essentially a flat surface (comprising the grids, each of which has a depressed center portion to collect the ball) having sloping sides.

Mason, in U.S. Pat. No. 3,966,212, describes a simulated gold green comprising a grid of square targets which are tiltable effect to transfer a golf ball landing on the target to a base plate for retrieval.

Bibeau, in U.S. Pat. No. 3,156,471, describes an inflatable golf target having a base portion and an upstanding target portion.

It can be seen that the art lacks designs for making a green that is easily positionable. Further, the art appears not to appreciate the need for a practice green that is able to be positioned where desired, and which can independently be altered in appearance. In essence, the art teaches fixed position targets having a predetermined configuration, which is typically merely a flat surface.

In fact, a problem apparently not appreciated by the art is that from a reasonable distance, such as 40 yards, a distance less than that from which one would typically take practice shots at the target green, the user cannot easily determine the depth of the target green. That is, when the long (hypotenuse) side of a wedge is viewed from a distance, the viewer has no visual clues as the length or inclination of the slope, and so cannot determine if the wedge is actually a wall or a very long graduated slope. The absence of such visual clues makes the benefit of such a practice green questionable.

OBJECTS AND SUMMARY OF THE PRESENT INVENTION

It is, therefore, an object of the present invention to provide an apparatus for use at a driving range to enhance the overall practice session by providing a sophisticated target to customers and practitioners at the range.

It is another object of the present invention to provide an apparatus that is configured to appear as a full scale green surface when viewed from a distance.

Yet another object of the present invention is to provide a realistic target green that is moveable or positionable on an earth surface (e.g., golf course, large backyard, open field) as desired by a user or golf instructor, and that can be easily moved or positioned without significant delay in using the device.

Still a further object of this invention is provide a realistic target green having an adjustable profile; that is, assuming the green is the hypotenuse of a right triangle, it is an object of this invention to provide the ability to vary the height of the vertical (back portion) of the green in order to present a target having a desired orientation.

It is an additional object of the present invention to provide an apparatus comprising a supported flexible surface having one or more selectively elevated portions to provide a more realistic contour to the target as well as improving the perceived depth of the target area. Yet another object of this invention is to provide a target green having an adjustable or alterable configuration, so that the target surface is not merely flat or, if contoured, not of a fixed contour.

The above and other objects of the present invention are realized in a specifically delineated target green apparatus formed of inflated structural sections. The target green is constructed at an incline. This incline creates the illusion of a green surface of significant overall area when viewed, preferably, from at least about one hundred yards or more. The green is preferably covered with a material to preclude excessive bouncing when struck with golf balls. The incline would facilitate the collection of used golf balls by directing\deflecting balls towards a common area for collection.

In accordance with the varying aspects of the present invention, separate structures associated with the green may be integrated with the target green. These include small traps, water, and rough, each portrayed at angles that accentuate their size to a viewer from a distance. A flag pin and hole is located on the surface with interconnects to register shots that end up in the hole for promotional purposes.

As well as the illusion of a larger hitting surface, the inclined target green of the present invention permits the golfer to directly observe where on the target green his shot has landed. As opposed to a flat landing area, the inclined surface is easily observed from a significant distance. This feedback is especially important in refining golf shot-making proximate to the green, where accuracy is critical.

In another embodiment, this invention provides an apparatus configured and constructed to give the outward appearance of a standard-sized golf green when supported on the ground and when viewed from a suitable distance, wherein the apparatus comprises (a) a target surface having the appearance of a golf green, (b) a supporting surface surrounding and integrally adjacent the target surface and having portions thereof adapted to extend to the ground on which the apparatus is supported, and (c) means for elevating a portion of the supporting surface (or the green) a desired amount. The means for elevating the supporting surface can be a set of extendable supports to alter the slope of the entire surface, and/or one or more inflatable devices disposed under the target surface to provide a contour or slope to the surface.

The foregoing features are more fully appreciated taken in conjunction with the following description of a specific illustrative example thereof including the following drawing.

DETAILED DESCRIPTION OF THE PRESENT INVENTION

Figure 1:
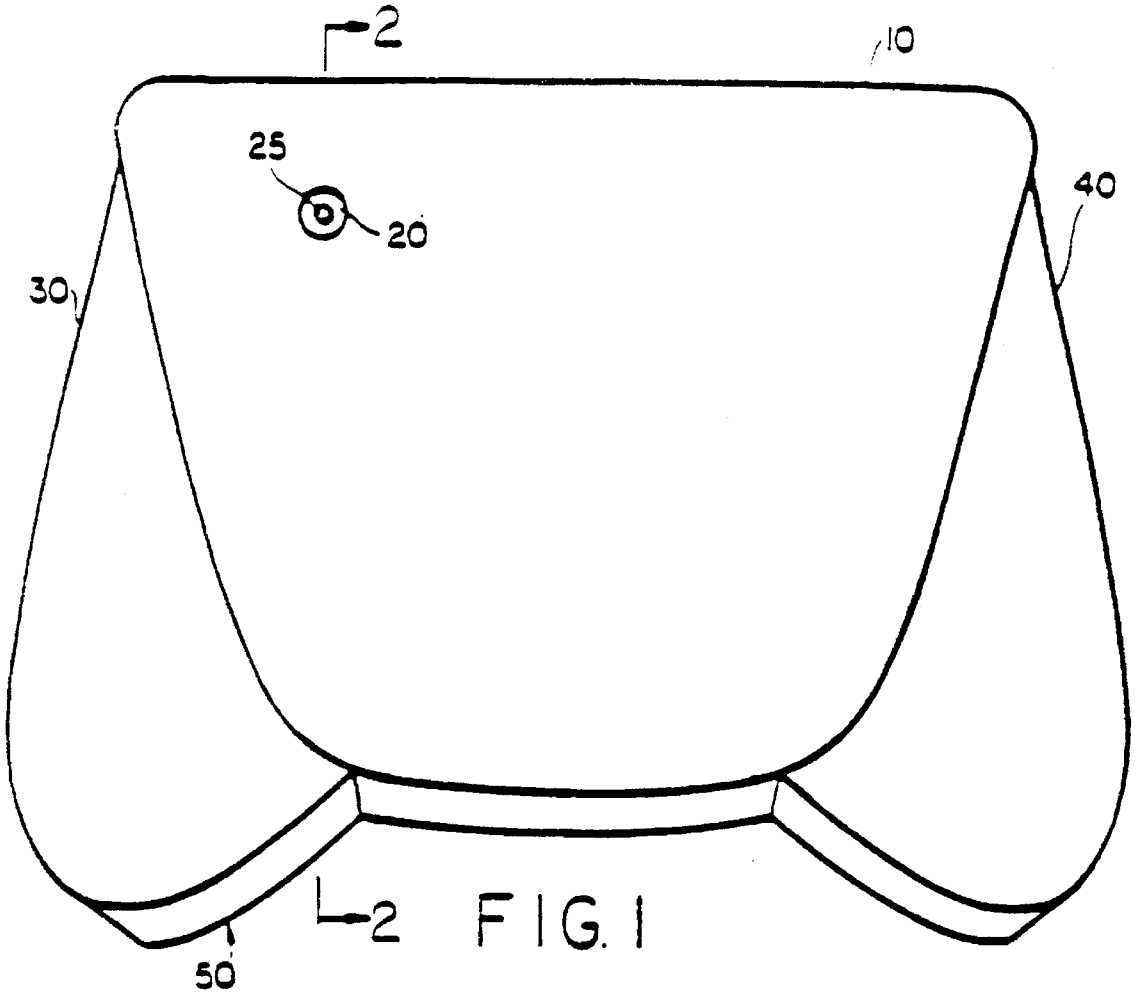
FIG. 1 depicts the inventive apparatus in both plan and cross-sectional views.

Turning now to FIG. 1, the present invention is a relatively large structure that provides the outward appearance of a traditional golf green. An actual golf green is a flat surface of carefully manicured grass having an appreciable area of up to several thousand square feet. The actual green will have a pin and hole located on its surface and possibly one of more hazards surrounding the surface. These hazards will include sand traps and water. The actual green is by its very nature expensive to build and maintain, and thus impractical at a driving range from a strictly economic standpoint.

The target green of the present invention has many of the attributes of an actual green, except on a scale significantly below that of the true green. In FIG. 1, the green surface, 10, is a small fraction of that normally associated with a true green, ranging from under 100 sq. ft. to several hundred sq. ft. in total surface area. The target green includes a traditional cup 20 (hole) with associated pin 25 and flag (flagstick). One or more hazards are located on either side of the target green; this may include a white sand trap facsimile 30 and a blue water trap facsimile 40 wherein the color is attained, via paint or similar. A skirt 50 is provided across the target green to direct driven golf balls to a common area.

Figure 2:
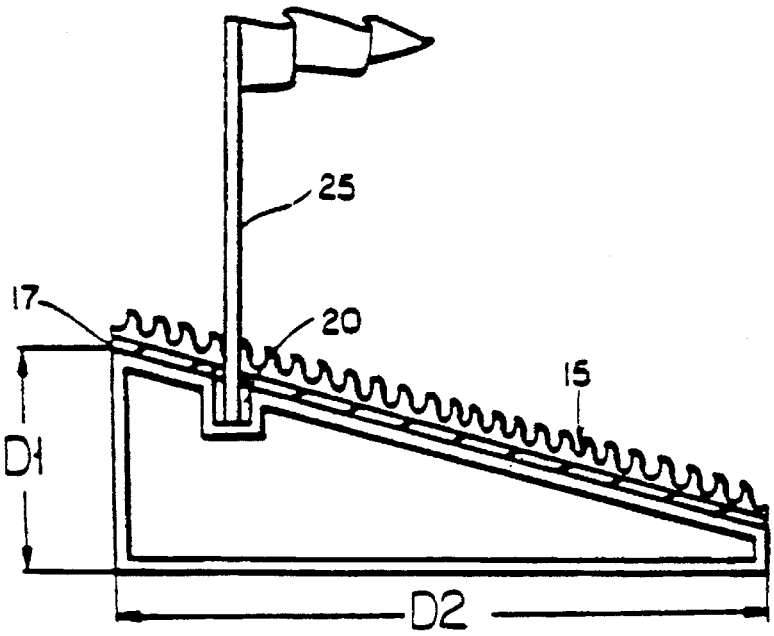
FIG. 2 depicts a cross-sectional view taken along line 2—2 of FIG. 1.

Turning now to cross-section 2—2 of FIG. 1, as depicted in FIG. 2, the target green is presented in a cut-a-way section. As can be seen, the target green is configured at an incline defined by the dimensions D1 and D2. By increasing D1, the overall size of the target green is increased in appearance when viewed from a distance. A suitable D2/D1 ratio would be approximately 10 when viewed from a distance of about 150 yards although this ratio may be changed to balance its appearance while providing a relatively flat landing surface. A minimum incline of 15 degrees is preferred to cause the depth perception illusion. More generally, the ratio of D2/D1 is about 12/1 or less, which translates into an approximate angle of inclination of at least about 5°.

Continuing with FIG. 2, the surface of the green includes a shock absorbing cushion 17 placed beneath the artificial turf 15. The turf itself may be varied in height and density in a manner that facilitates the retention of properly hit golf shots duplicating the experience attained on an actual golf course. This would allow closest to the pin competitions at the range.

System rigidity would be maintained by a network of support struts or braces. Alternatively, the target green can be constructed with an airtight material and slightly pressurized to retain its shape. Other methods of construction include closed cell foams or combinations of the above as may be dictated by the use of the system.

Figure 3A:
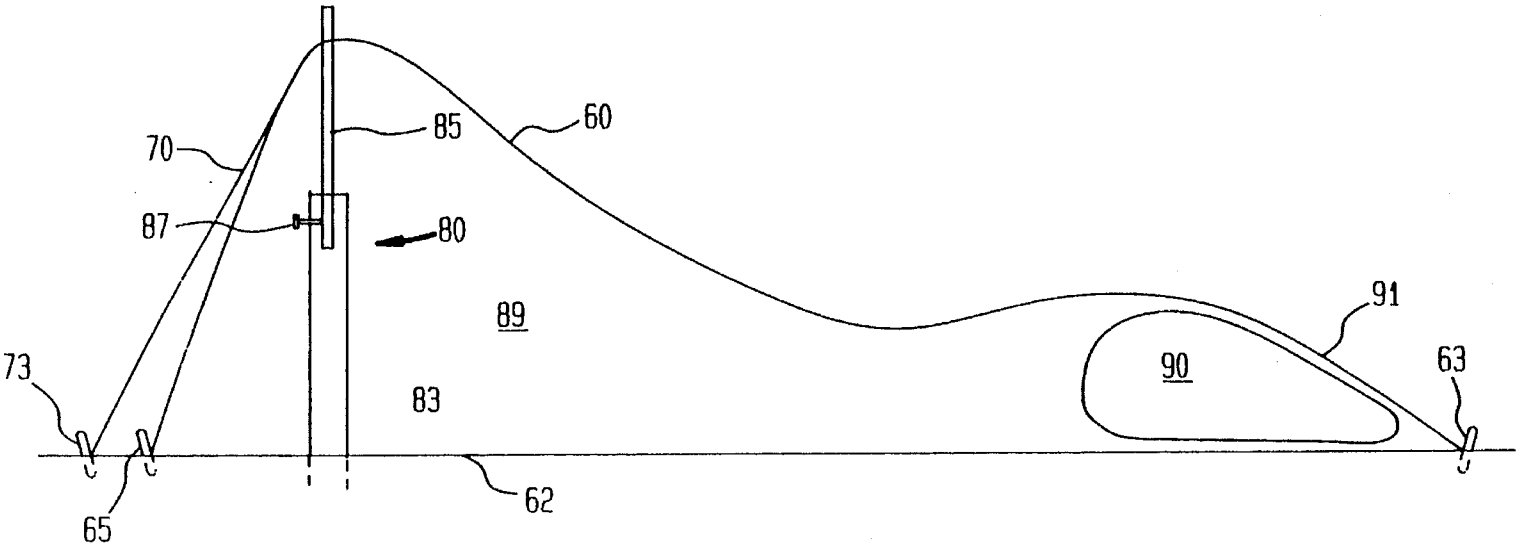
FIG. 3A depicts a cross-sectional view similar to that of FIG. 2 of an embodiment of this invention using inflatable elevation devices.

Another embodiment of the invention is shown in FIG. 3A, in which the surface 60 facing the player is constructed essentially as a tent, being selectively fixed to the ground 62 at the front and rear areas by stakes 63, 65 driven into the ground, preferably through grommets in the surface. To minimize the tendency of the practice green to move, bounce, or shake during windy days, a wind screen 70 can be used and likewise fixed to the ground by means of a stake 73.

As seen in FIG. 3A, the height (analogous to D2 in FIG. 2) can be changed by virtue of an adjustable elevating and support means 80, which thereby varies the pitch of the surface 60 and thus the corresponding apparent portion of that surface as seen by the user. The preferred embodiment shown includes a sleeve 83 driven into the ground and a post 85 adapted to fit within the sleeve and be retained at a desired height by a conventional mechanism, such as a set screw 87. Of course, a single pole could be used and driven further into the ground, or pulled up, to change the height of the back side. Although adjustment of the stakes holding the surface may be required, it is seen from this embodiment that alteration of the slope of the surface is made very easy by the present elevation and support means.

FIG. 3A also depicts the resulting interior portion 89 created under the target surface. Where the surface is akin to a tent, it is seen that the interior portion may billow, undulate, and deform in the wind, thereby presenting an apparently non-solid surface to the user. Additionally, such a configuration does not provide a realistic contour to the target surface as one might find on a real green. Accordingly, this invention preferably provides one or more elevation devices 90 which are placed in the interior portion to alter the contour of the entire target area; these devices are discussed below in more detail. The particular elevation device shown in FIG. 3A is inflatable, and can be inflated to a desired extent to achieve a desired contour to the green.

A significant advantage in using any elevation device is to provide visual clues to the user of the target green as to the actual depth of the green. As mentioned above, a wedge when on its side and pointed to a viewer may appear as a wall, or may appear as a wedge having an indeterminate slope. When the elevation device is placed at the leading edge 91 of the target green (e.g., creating a mound at the leading edge), and/or the leading edge is colored differently than the more rearwards portions of the target green (e.g., simulating a sand trap), the user is provided with a visual clue as to the location of the front edge of the target green, and is thus able to more easily discern the entire slope and contour of the entire structure. In other words, the present invention provides means for affecting perception of the distance and depth of the target green by the user, thereby allowing the user to concentrate on practicing rather than on trying to determine the distance and/or geometry of the target area. It is preferred that at least one portion of the leading edge of the target green include a different coloring and/or different elevation to provide the desired depth perception to the user.

Figure 3B:
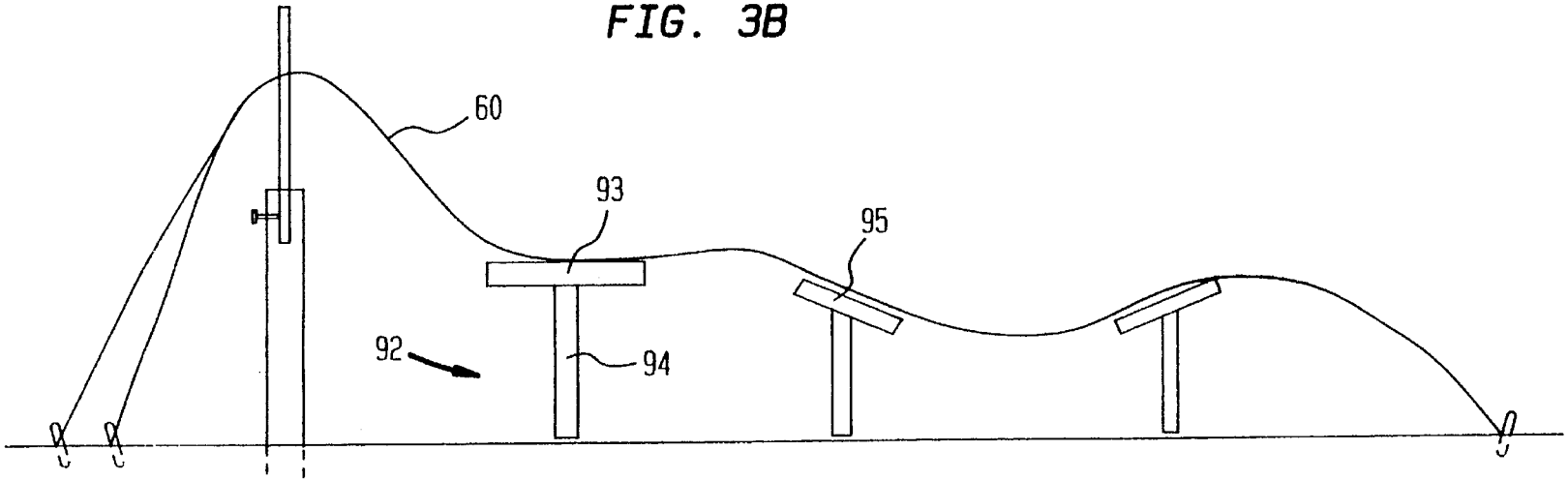
FIG. 3B is a cross-sectional view similar to that of FIG. 3A but using pedestal-type elevation devices.

FIG. 3B depicts a more preferred embodiment of the invention that utilizes a number of pedestals 92 for supporting the surface 60 in a desired configuration. The pedestals are kept in place essentially by the weight of the surface, although they may be driven into the ground as described previously for the sleeve (83). Each pedestal generally contains a pedestal top 93 generally planar in configuration and a pedestal bottom 94. The pedestal top and bottom may be in a fixed orientation to each other such that they are orthogonal (e.g., forming a horizontally supported planar surface), may be in a fixed angled position as shown in pedestal top 95, or may connected such that the top can be angled or tilted to a desired degree with respect to the pedestal bottom and/or in a desired direction with respect to the orientation of the target green. The pedestal top can be covered with at least one, preferably two, layers of foam, most preferably covering the edges of the pedestal, to avoid the edges and/or corners of the pedestal tearing, puncturing, or otherwise injuring the surface due to its own weight on the pedestal as well as due to the impact of golf balls. The placement and use of the pedestal elevation means allows one to provide a target green having a desired elevational contour.

As mentioned above, the use of elevation means to alter the contour of the surface avoids the significant problem of the user not being able to determine the depth of the target area. To more fully illustrate this improvement, reference is made to FIG. 4A, which depicts an idealized side view of a wedge-shaped surface 60 disposed on the ground 62. In a front (i.e., user-oriented) view shown in FIG. 4B (the direction of view being indicated by the arrow 4B in FIG. 4A), it is seen that the target appears merely as a wall to the user. Absent any clear identification of where the surface contacts the ground and the depth of the surface, the user has no perception of the depth of the target area.

Figure 4C:
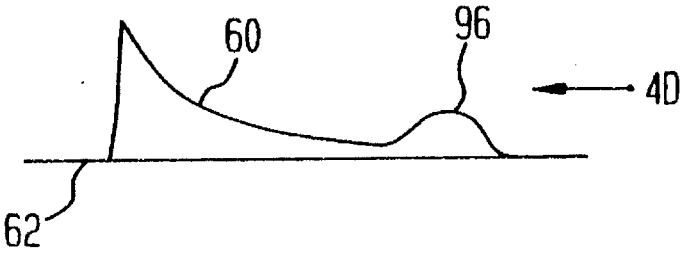
FIGS. 4C and 4D depict idealized side and front views of an improved target green according to this invention.
Figure 4D:
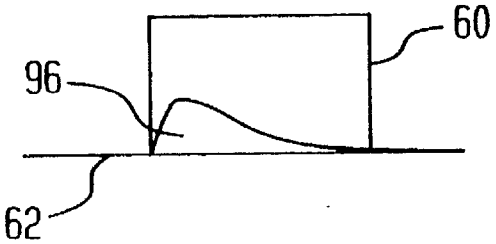
Figure 4A:
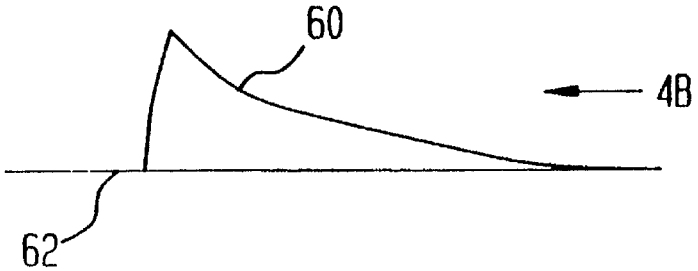
FIGS. 4A and 4B depict idealized side and front views of a wedge-shaped target green.
Figure 4B:
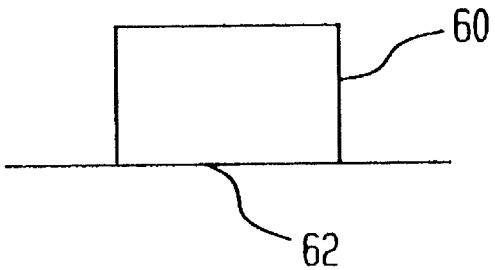

In contrast, FIG. 4C is an idealized side view of the present invention's use of an elevation means near the front of the target area to provide a mound 96. When such a device is viewed by the user, as shown in FIG. 4D, the mound at the front surface provides a distinct shape that serves as a visual clue enabling the user to perceive the depth from the front mound to the back of the target area.

Figure 5A:
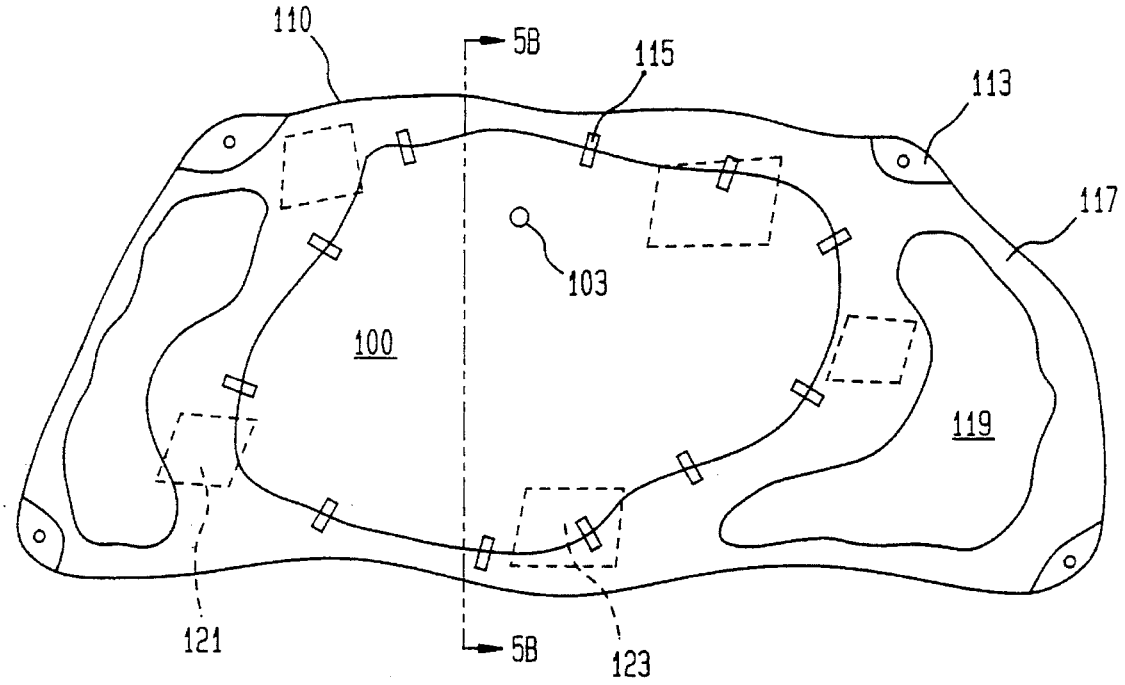
FIGS. 5A depicts an overhead view of another embodiment of the present invention.

FIG. 5A depicts an overhead view of another embodiment of the inventive target green. The target green itself preferably is green in color and includes are area and/or device 103 indicating a hole and preferably includes an associated pin and flag (not shown). The target surface is supported by a support surface 110; the support surface includes reinforced areas 113 adapted for fixing the support surface to the ground via stakes and/or adjustable poles as described above (and not shown in this figure). An overnet 114 is attached to the support surface over the target area by a number of clips 115 or any other suitable means, such as buttons and associated button holes, a zipper, mechanical hook and loop fasteners (e.g., VELCRO brand), and the like. The coloring and appearance of the supporting surface is preferably such as to convey to a viewer an area of rough 117 and optionally one or more hazards, such as sand traps 119. Disposed beneath the surfaces viewed by the user, one or more pedestal-type elevation devices 121 are provided and positioned under the green, the support surface, or both, to produce a contour more closely approaching that found on true greens; preferably, at least one such elevation device is provided near the front portion of the device (i.e., closest to the user).

Figure 5B:
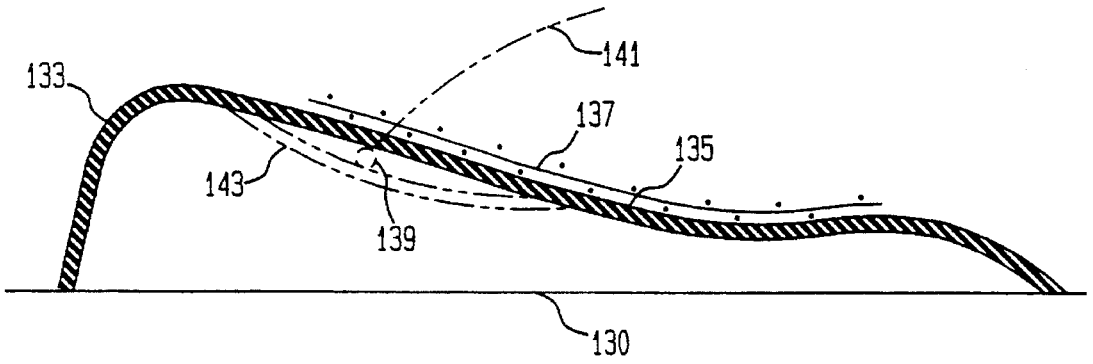
FIG. 5B depicts a cross-sectional view therethrough along line 5B—5B of FIG. 5A.

FIG. 5B depicts a cross-sectional view through FIG. 5A as shown therein. The entire green is supported by the ground 130 or some other structure. The support surface 133 is preferably plastic, such as nylon, of sufficient toughness and durability to withstand impacts from golf balls and wear and tear due to exposure from the elements. A preferred material for the target green is sold as Polymesh netting (an open weave polypropylene netting available from Revere Plastics, Inc., Little Ferry, N.J.). The target surface 135 (i.e., the "green" as seen by the user and on which the balls are intended to land) is preferably covered with an overnet 137 or any other similar mesh which is sufficiently robust to withstand the impacts of golf balls, and having holes sufficiently large so as to let a golf ball pass therethrough; the target surface has a weave sufficiently closed to retain a ball.

The use of a mesh is preferred for the target surface and the overnet to allow sunlight and water to penetrate to the underlying ground, thereby tending to reduce damage to the existing grass on which the present practice green in positioned. Thus, the most preferred embodiments include target and overnet portions that are light, air, and water permeable, and are also sufficiently robust to withstand and stop golf balls landing thereon.

The overnet preferably has a mesh size that allows a ball to pass through the overnet and contact the target area. As shown in FIG. 5B, the overnet is positioned adjacent the green area and lies essentially thereon. A suitable overnet is a woven nylon netting having holes approximately 2–2½" therein, although somewhat larger or smaller hole sizes can be used (e.g., Model 245 nylon fiber net available from Synco Group, East Hampton, Conn.). It should be recognized that the overnet has a weave significantly more open than the target surface, such that the user perceives the target area but may not perceive the overnet. In general, a taut sheet-like surface, as used herein, will act much like the head of a drum due to tension caused by its own weight, essentially providing a very impact responsive surface. A ball will pass through the overnet and land on the target surface disposed below the overnet, but without the overnet the ball would be flung back into the air after contact with the surface. In the practice of the present invention, a ball 139 on an incoming trajectory 141 will impact and cause the target surface to deflect downwards 143 (dotted lines) and the ball will roll towards the lowest elevation, generally towards the front of the target. As the target surface returns to its original (pre-impact) elevation the rolling ball will contact the overnet; this contact with the overnet causes the rolling ball to bounce or pop out of the target area. Thus, this invention overcomes a significant problem of providing a surface on which a hit ball can impact and, instead of immediately rebounding up, or coming to a rest, will roll and be ejected from the target area. Because the ball will pop-off of the target area in a controlled manner, retrieval of balls with typical automated or semiautomatic equipment from the driving range is facilitated.

In yet another embodiment of the present invention, such as for home use where the distance between the user and the target green may be 50 yds. or less, it is generally not necessary to provide a different coloration and/or elevation at the front surface to provide visual clues as to depth perception.

The above-described arrangement is merely illustrative of the principles of the present invention. Numerous modifications and adaptations thereof will be readily apparent to those skilled in the art without departing from the spirit and scope of the present invention.

What is claimed is:

1. An apparatus configured and constructed to give the outward appearance of a standard-sized golf green when supported on the ground and when viewed from a suitable distance, comprising:

(a) a target surface having the appearance of a golf green;

(b) a supporting surface surrounding and integrally adjacent the target surface and having portions thereof adapted to extend to the ground on which the apparatus is supported, the support surface having a front portion;

(c) means for elevating selected portions of the supporting surface and/or the target surface; and (d) overnetting overlaying the target surface, such overnetting having a weave sufficiently large to allow a golf ball to pass therethrough.

2. The apparatus of claim 1, further comprising: (e) a portion of said front portion of the support surface being elevated from the ground and/or having a coloration different than the ground.

3. The apparatus of claim 1, wherein the means for elevating comprises one or more sleeves each having a post adjustable therein at a desired height and effective for supporting the supporting surface above the ground.

4. The apparatus of claim 1, wherein the means for elevating comprises one or more pedestals positionable under the supporting surface and/or the target green.

5. The apparatus of claim 4, wherein the pedestal comprises a pedestal base and a pedestal top attached thereto by means allowing said top to be angled with respect to said base.

6. The apparatus of claim 1, wherein the overnet is releasably connected with and supported by the target surface.

7. The apparatus of claim 1, wherein the support surface includes indicia of sand, water, or other hazards.

8. The apparatus of claim 1, wherein the support surface comprises a material having permeability or porosity to at least one of sunlight and water.

9. The apparatus of claim 1, wherein the target surface comprises a material effective to retain golf balls thereon and effective to allow light and rain to penetrate therethrough.

10. The apparatus of claim 1 having a slope of at least about 5°.

11. The apparatus of claim 1, wherein the overnetting comprises polypropylene.

12. A target green for golf practice, said target green being moveable or positionable on a ground surface, and comprising:

(i) a tent having (a) a target area appearing like a golf green and (b) a supporting area extending to the ground surface;

(ii) means for elevating, at selected heights above the ground surface, selected portions of the tent;

(iii) means for securing the tent to the ground surface; and (iv) overnetting overlaying the target surface, such overnetting having a weave sufficiently large to allow a golf ball to pass therethrough.

13. The target green of claim 12, wherein the means for elevating selected portions of the tent comprises a pedestal.

14. The target green of claim 13, wherein the pedestal comprises a top having an adjustable orientation.

15. The target green of claim 13, wherein the pedestal comprises a top having padding thereon.

16. The target green of claim 12, wherein the overnetting comprises polypropylene.

17. The target green of claim 12, wherein the tent further comprises (c) a front area having a different coloration than the target and supporting areas.

18. The target green of claim 12, wherein the means for elevating selected portions of the tent is inflatable.

19. The target green of claim 12, wherein the elevation of the tent from the ground surface is at least about 5°.

20. The target green of claim 12, wherein the target surface, the supporting surface, or both comprise a mesh.

* * * * *